United States Patent [19]

Scheuter

[11] Patent Number: 4,867,389

[45] Date of Patent: Sep. 19, 1989

[54] CHUCK FOR WINDING CORES

[75] Inventor: Siegbert Scheuter, Herbrechtingen, Fed. Rep. of Germany

[73] Assignee: J. M. Voith GmbH, Heidenheim, Fed. Rep. of Germany

[21] Appl. No.: 240,970

[22] Filed: Sep. 6, 1988

[30] Foreign Application Priority Data

Sep. 12, 1987 [DE] Fed. Rep. of Germany ..... 3730767

[51] Int. Cl.[4] ..... B65H 18/04; B65H 18/10

[52] U.S. Cl. ..... 242/68.4; 242/57

[58] Field of Search ..... 242/68.4, 68.1, 68.2, 242/68.3, 57, 129.51; 279/1 DC

[56] References Cited

U.S. PATENT DOCUMENTS

| | | | |
|---|---|---|---|
| 3,381,912 | 5/1968 | Huck | 242/68.4 X |
| 3,881,666 | 5/1975 | Greenhalgh | 242/68.2 |
| 4,358,066 | 11/1982 | Deutsch et al. | 242/68.4 |
| 4,483,493 | 11/1984 | Schonmeier | 242/68.4 X |
| 4,697,756 | 10/1987 | Kofler | 242/68.4 X |
| 4,715,553 | 12/1987 | Hatakeyama et al. | 242/68.4 |

FOREIGN PATENT DOCUMENTS

| | | | |
|---|---|---|---|
| 2628788 | 3/1978 | Fed. Rep. of Germany | 242/68.4 |
| 2815310 | 6/1982 | Fed. Rep. of Germany . | |

*Primary Examiner*—John M. Jillions

*Attorney, Agent, or Firm*—Albert L. Jeffers; Richard L. Robinson

[57] ABSTRACT

A longitudinally movable chuck for winding cores onto which web-like material, such as paper etc., is wound is longitudinally movable by means of a motorized drive. The chuck includes a clamping core which grips into the winding core. The end face of the winding core is supported against a stop of the clamping core. The clamping core is longitudinally movable on a central part of the chuck. Between the central part and the clamping core a compression spring is located for exerting an axially acting clamping force on the winding core. The central part is provided with a switch which is actuable by the longitudinally shifted clamping core. The switch acts on the motorized drive to achieve a relatively precisely adjustable clamping force.

7 Claims, 1 Drawing Sheet

CHUCK FOR WINDING CORES

BACKGROUND OF THE INVENTION

This invention relates to a longitudinally movable chuck with a motorized drive for winding cores.

Conventionally, chucks grip a winding core at both ends or grip both ends of a set of winding cores arranged in line in a roll bed of a winding machine. For this purpose, the chucks are run into the core ends by a motor. Apart from their exact axial positioning, the cores require an axial tensioning by a clamping force of a well-defined magnitude. To achieve this clamping force, the electric motor drive is used for axial adjustment of a chuck. A motor control system records the speed drop of the motor which occurs after the chuck stop grips the end face of the core, this drop being due to the adjustment resistance, and switches the motor off. Because of this mode of operation, the clamping force is subject to considerable fluctuations during successive clamping operations and is especially strongly influenced by frictional resistances in the drive line of a chuck.

From DE-Patent Specification No. 28 15 310, a chuck of the aforementioned type arranged at the end of a longitudinally movable shaft is known, which discloses axially shiftable internal wedge pieces mounted on a shaft end. This arrangement is fitted with external wedge pieces likewise guided to be axially movable on the internal wedge pieces. Upon introduction of the chuck into a winding core, the core which grips with its end face a stop of the external wedge pieces causes an axial shifting of these wedge pieces relative to the internal wedge pieces. The external wedge pieces spread out until they come to rest at the core inside periphery. The continued axial movement of the chuck now results in a simultaneous shifting of the external and internal wedge pieces relative to the shaft end against the force of a compression spring which is located in the shaft end as well as supporting itself on the one side against the shaft and on the other side directly against the internal wedge pieces.

The spring clamping force reaches its maximum value when the external and internal wedge pieces run onto a stop of the chuck shaft. This force which acts axially against the winding core can be influenced by changing the preloading of the compression spring, but it varies in its magnitude because of the tolerances of the core inside diameter, which alter the shifting path of the external wedge pieces relative to the internal wedge pieces, and thus the deflection of the compression spring. In addition, the winding core is loaded by axial forces of different magnitudes because of the tolerances in the shut-down time point of the axial drive moving the chuck, since the external wedge pieces have run against the stop of the chuck shaft. The strongly differing axial forces acting on a winding core or a set of cores clamped between two chucks are partly absorbed by the elastic deformation of the cores which are made of board, and partly by the support of the chuck as well as its guide carriage in the machine frame of the winding machine. Excessive axial forces, however, may cause damage to the thrust bearings, after a relatively short operating time of the winding machine, especially if steel winding cores are used instead of board winding cores.

An object of the invention is therefore to create a chuck whose axial clamping force acting on a winding core is adjustable to a relatively precise extent.

SUMMARY OF THE INVENTION

The present invention, in one form thereof, overcomes the disadvantages of the above described chucks for winding cores by providing an improved chuck therefor. The present invention comprises a chuck which is longitudinally movable by a motorized drive for winding cores onto which web-like material, such as paper, is wound. The winding core is internally gripped by a clamping core. The end face of the winding core stops against a collar of the clamping core. The clamping core is longitudinally movable on a central part of the chuck. A compression spring is supported between the central part and the clamping core. The central part is provided with a switch by the longitudinally moved clamping core for controlling the motorized drive.

The solution is advantageous as only the amount of the axial shifting of the clamping core on the central part against the force of the compression spring is used as the criterion for drive shut down. Thus the force of the compression spring acts solely as a clamping force on the winding core, this spring being influenced only to a minor extent by the frictional resistance between the clamping core and the central part. Influences of the chuck adjusting drive are thus largely ruled out. Switching tolerances can be minimized in their effect on the clamping force by a compression spring with a relatively flat spring characteristic. Irrespective of the core material, clamping forces are thus generated which are precisely adjustable and repeatable in the same magnitude.

Another advantage of the present invention is that a switch may be used which is characterized by freedom from mechanical wear.

Still another advantage of the present invention is that the switch is protected against damage and contamination.

Yet still another advantage of the present invention is that the clamping force of the chuck can be precisely adjusted and easily matched to changed requirements.

A further advantage of the present invention is that the spring characteristics and thus the clamping force of the chuck can be varied in a simple way according to the requirements by appropriate selection and arrangement of the disc springs. In addition, the springs require only a small amount of space and, if installed concentrically, do not cause any unbalance in the chuck when it rotates at high speed.

BRIEF DESCRIPTION OF THE DRAWINGS

The above mentioned and other features and objects of this invention and the manner of attaining them will become more apparent and the invention itself will be better understood by reference to the following description of an embodiment of the invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
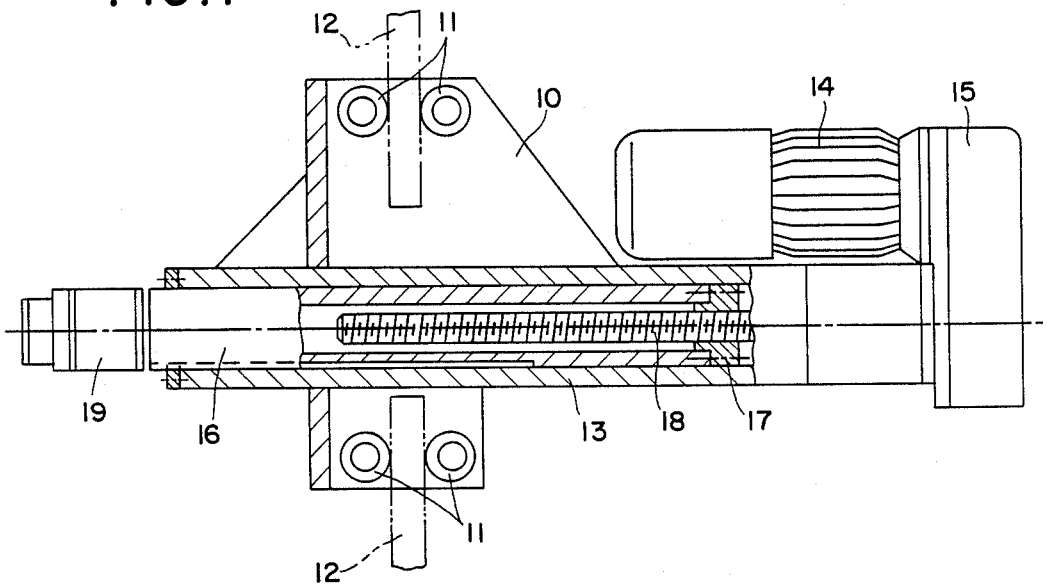
FIG. 1 shows a cross sectional view of a core guide carriage with a chuck.

Referring to FIG. 1, a core guide carriage 10 exhibits pairs of guide rollers 11 with which it grips vertically arranged guide rails 12 (marked in dashed lines). The carriage 10 is equipped with a horizontally running guide tube 13 which supports an electric drive motor 14 with a flange-mounted gear unit 15. Guided longitudinally and unable to be rotated in the tube 13 is a feed tube 16. To its one end, the feed tube 16 is fastened with a nut 17 which grips a threaded spindle 18 which extends coaxially through to the guide tube 13. This spindle 18 is connected (in a way not shown) with the gear unit 15 of the electric drive motor 14. At its other end projecting out of the guide tube 13, the feed tube 16 supports a chuck 19.

Figure 2:
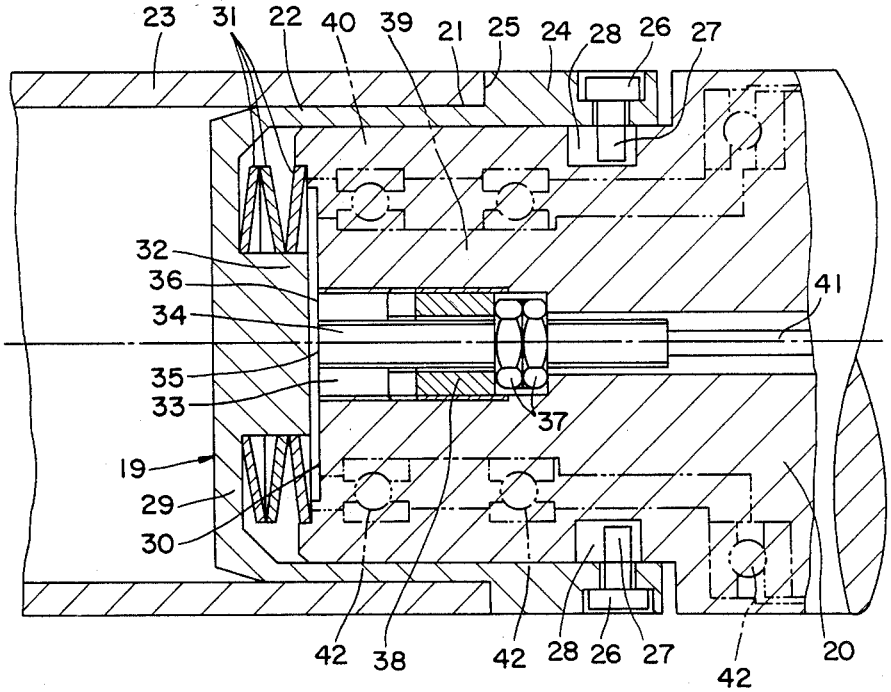
FIG. 2 shows the chuck gripping a winding core, predominantly in sectional view and in natural size.

Referring now to FIG. 2, the chuck 19 has a cylindrical central part 20 on which a clamping core 21 is guided to be longitudinally slidable. The clamping core 21 displays a shouldered portion 22 for centering accommodation of a winding core 23. Connected to the section 22 is a collar 24 which is used as a stop for the end face 25 of the winding core 23. Screwed into the collar 24 are locating screws 26 whose projecting ends 27 extend into recesses 28 of the central part 20. The locating screws 26 prevent the clamping core 21 from being pulled off the central part 20 when the chuck 19 runs out of the winding core 23.

The clamping core 21 is provided against the winding core 23 with a face wall 29 gripping over the central part 20 at the end face. Between this face wall 29 and the end face 30 of the central part 20 are arranged layered disc springs 31 concentrically with the chuck axis. These are guided on a cylindrical portion 32 of the core end wall 29 directed against the central part 20. The springs 31 exert a force which endeavours to move the clamping core 21 towards the left relative to the central part 20 in FIG. 2.

The central part 20 exhibits a shouldered borehole 33 which is coaxial with the longitudinal axis of central part 20. In this borehole 33 is located a switch 34 acting on the motorized drive for effecting longitudinal movement of the chuck. Switch 34 is designed as an inductive proximity switch whose active contact surface 35 lies in the plane of the end face 30 of the central part 20. The end face of the cylindrical portion 32 of the clamping core 21 acts as measuring surface 36 allocated to the switch 34. The switch 34 is axially adjustable with adjusting nuts 37 and held in the central part 20 with a threaded sleeve 38.

The clamping operation of the winding core takes place as follows:

First the core guide carriage 10 is run with retracted chuck 19 (see FIG. 1) by a drive (not shown) in line with the winding core 23 inserted in the roll bed of a winding machine. By energizing the drive motor 14, the feed tube 16 with chuck 19 is shifted longitudinally relative to the carriage 10 so that the clamping core 21 grips in the winding core 23. The clamping core 21 takes up a position relative to the central part 20 in which the disc springs 31 are almost relieved. In this position the tripping distance between the active contact surface 35 of the switch 34 and the measuring surface 36 of the core face wall 29 is relatively large. The proximity switch 34 exhibiting a normally closed function lying in series with the electric drive motor 14 is therefore closed.

As soon as the collar 24 of the clamping core 21 meets the end face 25 of the winding core (a second chuck grips the other end of the winding core), the clamping core 21 is moved relative to the central part 20 and the disc springs 31 are compressed. The clamping force exerted by the chuck 19 on the winding core 23 increases according to the spring characteristic with simultaneous reduction of the tripping distance. On reaching the adjusted tripping distance between the measuring surface 36 of the core end wall 29 and the active contact surface 35 of the proximity switch 34 (FIG. 2), the latter opens and blocks the current circuit of the drive motor 14 for the longitudinal feed of the chuck 19. In this position, the compressed disc springs 31 exert a force on the end wall 29 of the clamping core 21 which corresponds to the predetermined clamping force of the chuck 19 on the winding core 23. By axial adjustment of the switch 34 the spring force is alterable in the tripping point. Influence on the clamping force can also be effected by selection of different springs (e.g. helical compression springs) with different spring characteristics.

During operation of the winding machine, the winding core 23 and parts of the chucks 19 gripping the winding core rotate. To simplify a transmission of the current flowing through the switch 34 to the motor control system, the switch 34 may be expediently arranged stationary relative to the rotating clamping core 21. For this purpose, as indicated in FIG. 2 with dashed lines, the central part 20 of the chuck 19 is subdivided into an inner part and an outer part. The inner part 39 is connected non-rotatably with the feed tube 16 and takes up the proximity switch 34 with its connecting cable 41. The outer part 40 surrounds the inner part 39 and is rotatably mounted on this with antifriction bearings 42. The disc springs 31 are supported on the outer part 40, on which the clamping core 21 is guided to be longitudinally movable.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and all within the limits of the appended claims.

What is claimed is:

1. A chuck (19) adapted to be longitudinally movable by motorized drive (14) for winding cores (23) onto which web-like material, such as paper etc., is wound, said chuck comprising a clamping core (21) for gripping into a winding core, the end face (25) of said winding core being supported by a stop (24), located on said clamping core (21), said chuck including a central part (20) on which the clamping core (21) is guided to be longitudinally movable, and with a compression spring (31) supported between the central part (20) and the clamping core (21), characterized in that the central part (20) is provided with a switch (34) which controls the motorized drive (14) and is actuable by the longitudinal movement of said clamping core (21).

2. A chuck according to claim 1 characterized in that said switch comprises a proximity switch (34) which is located in said central part (20), said clamping core (21)

being equipped with a measuring surface (36) operatively associated with said switch.

3. A chuck according to claim 1 characterized in that said switch (34) is located centrally in said central part (20) and is actuable from an end face (29) of the clamping core (21).

4. A chuck according to claim 1 characterized in that the switch (34) is axially adjustable in the central part (20).

5. A chuck according to claim 2 wherein said switch (34) is located centrally in said central part (20) and is actuable from an end face (29) of the clamping core (21).

6. A chuck according to claim 3 wherein said switch (34) is axially adjustable in the central part (20).

7. A chuck according to claim 1 characterized in that the compression spring comprises a disc spring (31) arranged concentrically to the axis of said chuck between the end wall (29) of the clamping core (21) and the end face (30) of the central part (20).

* * * * *